United States Patent [19]

Magid

[11] Patent Number: 4,629,433

[45] Date of Patent: Dec. 16, 1986

[54] INFLATABLE ARTICLES AND METHOD OF MAKING SAME

[76] Inventor: Sidney H. Magid, 4th Floor, No. 10, Lane 12, Alley 5, Jen Ai Road, Sec. 4, Taipe, Taiwan

[21] Appl. No.: 624,900

[22] Filed: Jun. 22, 1984

Related U.S. Application Data

[63] Continuation-in-part of Ser. No. 426,998, Sep. 29, 1984, abandoned, which is a continuation of Ser. No. 176,247, Aug. 7, 1980, abandoned.

[51] Int. Cl.[4] ..... B63C 9/04

[52] U.S. Cl. ..... 441/40; 52/2; 441/129

[58] Field of Search ..... 156/145, 146, 290, 292, 156/308.4, 583.1; 53/DIG. 2, 477; 52/2; 114/345; 441/40, 41, 129

[56] References Cited

U.S. PATENT DOCUMENTS

| | | | |
|---|---|---|---|
| 929,313 | 7/1909 | Krieger et al. | 9/337 |
| 2,631,646 | 3/1953 | Gannon et al. | 53/DIG. 2 |
| 2,939,158 | 6/1960 | Baker | 9/13 |
| 3,056,980 | 10/1962 | Holladay | 9/13 |
| 3,363,268 | 1/1968 | Friedlander | 52/2 |
| 3,481,087 | 12/1969 | Stafford | 52/2 |

*Primary Examiner*—Sherman D. Basinger

*Attorney, Agent, or Firm*—Roylance, Abrams, Berdo & Goodman

[57] ABSTRACT

Inflatable article made of air impervious thermoplastic sheet materials including one or more inflatable units having one or more inflatable valves provided thereon respectively for injecting air into those one or more inflatable units, wherein at least two seals, with one of the seals being a stabilizing seal and being adjacent or touching one of the other seals, are located at selected inner and/or outer portions of the inflatable article with the stabilizing seals providing the selected portions with essentially flat and unruffled constant length seals which remain flat and constant length whether the inflatable article is inflated or deflated thereby permitting another article or articles with constant length portions to be joined to the selected stabilized constant length portions of the sealed inflatable article which would not have been possible if stabilizing had not been effected. A method for making inflatable articles having stabilizing seals that includes inflating the articles before providing the stabilizing seal or seals.

10 Claims, 21 Drawing Figures

INFLATABLE ARTICLES AND METHOD OF MAKING SAME

This is a continuation-in-part of application ser. No. 426,998 filed Sept. 29, 1984, now abandoned, which is continuation of Ser. No. 176,247, filed Aug. 7, 1980, now abandoned.

BACKGROUND OF THE INVENTION

The present invention relates to inflatable articles and a method for making same.

Inflatable articles made of air impervious sheet materials usually comprise at least one top sheet and a bootom sheet joined by glue, direct heat or high frequency dielectric induced heat sealing if the sheet material is PVC plastics. The joining of the two sheets, in the shape of parallel lines or otherwise, causes the centerline of the article and portions of the article parallel to the centerline to shorten upon inflation and ruffle.

If it is desired to attach the portion of the inflated article that is ruffled upon inflation to a part of another article which is the similar length as the length of the centerline of a linear inflated article or the similar length of the peripheral outer portion of an inflated concentric seal article, this can not be done due to the original long length of the ruffled portions. When the ruffled portions are flattened and made into unchanging lengths, which is what the stabilizing seal does, the attachment can be made, since there will be no ruffling with inflation or deflation.

SUMMARY OF THE INVENTION

It is therefore the main object of the present invention to provide an inflatable article having flat and unruffled outer and/or inner portion(s) so that further attachment to another article or component of another article can be done at said outer and/or inner portion(s) that are normally ruffled on inflation.

Another feature of this invention is a method for providing the inflatable article with a stabilizing seal which has not heretofore been practiced. It is best that the article be inflated to give the correct length for the stabilizing seal for the linear sealed article and it is essential that the circular inflatable article be inflated in order to apply the stabilizing seal.

The method for making inflatable articles with a stabilizing seal comprises a first step of forming a basic inflatable which consists of one or more inflatable units having one or more inflatable valves provided on it respectively; a second step of inflating said basic inflatable; a third step of locating, for a linear seal article, the selected inner and/or outer portion of the basic article in a suitable press, or for a concentric seal article, locating the article in a suitable die and press; and a fourth step of applying the stabilizing seal or seals on the selected portions by pressure and direct or induced heat.

The method may include, before or after step three, a step of locating another material in the press in a die so that these materials will be joined to the basic inflatable at the same time the stabilizing seal or seals are applied.

For the purpose of understanding the terms used in this application, they are defined as follows:

1. Air impervious thermoplastic sheet materials are those which are in flexible sheet form made of all or in part of plastics, which melt and deform under heat and pressure and hold air or gas when formed into a fully enclosed envelope.

2. inflatable units are inflatable sections, each having their own inflating valve, which make up the inflatable article.

3. Inner and outer portions are those parts of the inflatable article, which for the inner portions are on the inside of the article which has a cut out section surrounded by an air enclosing seal, and which for the outer portions are on the outside of the article which has an air enclosing seal. These portions include said seals and the area adjacent to and outside of said seals. A portion which is referred to without stating its location refers to inner and/or outer portions.

4. A stabilizing seal is one made by using heat and pressure on the inner and/or outer portions of said article. This seal causes stabilizing by compressing the rufflings caused by inflation of the article, thereby creating a seal which does not permit the ruffling to return to its original flat length. This stabilizing seal can also be referred to as a flat and unruffled constant length seal.

5. A stabilized portion is that portion that has on it a stabilizing seal.

6. Basic inflatable is the term used for the inflatable article which has not yet been stabilized with the stabilizing seal or seals.

7. A component is a part of any article that is made of more than one part.

8. For direct and induced heat, direct heat is that heat which passes directly from the hot element to the part being heated. Induced heat is that heat which is caused by electronic forces which is due to the dielectric characteristics of the plastics being heated. When only the word heat is used without stating the kind of heat, that kind of heat suitable for the materials of the inflatable article is to be used.

9. Pressure is the force imposed on the material being stabilized by dies required in a suitable press to create this pressing force.

10. Means for joining is any facility, inherent in the article, or attached to the article, mechanical or otherwise, which enables the article to be attached to another article or component of an article.

11. Various kinds of materials are those which are made of textiles, wood, metal, paper, glass and any plastics, hard or soft, etc..

12. Centerline refers, in the instance of inflatable articles having bars or linear seals joining the top and bottom sheets forming the article, to a line drawn from side to side of the article through the inflatable unit or units and at right angle to the linear seals stated above. In the instance of inflatable articles having concentric seals, joining the top and bottom sheets, it refers to lines at right angle to the concentric seals. The inflated linear seal article will have portions ruffled that are parallel to the centerline and the inflated concentric seal article will have essentially the entire outer portion ruffled until the stabilizing seal is applied.

13. Shorten and lengthen refers to the inflatable unit or units and the effect they have on the inner and/or outer portions of the inflatable article.

Shorten on inflation means inflating air causes expansion of the space between the top and bottom sheet materials forming the inflatable article. This expansion shortens the distance between the unit seals and shortens the line that is the actual distance between the outermost seals.

Lengthen on deflation means that the line that is the distance between the outmost seals lengthen when the article is deflated.

The above lines are lateral centerlines for linear sealed articles and are at right angles to the line seals forming the inflatable unit or units for concentric seal articles. The above shortening and lengthening lines are at right angles to the concentric seal lines forming the inflatable unit or units such as for round or modified round articles such as ovals, etc.. Shortening of the centerline of articles formed by linear seals causes ruffling on inner and/or outer portions parallel to the lateral centerline. Shortening of lines at right angles to the concentric seal lines of round articles causes ruffling essentially of the entire outer portion around that article.

14. The terms, adjacent to, used to define the interrelationship between a stabilizing seal and an air enclosing seal, should also be interpreted to be touching or adjacent to, which carries out the same function.

An important feature of the inflatable article of the present invention, for linear seal articles is a stabilizing seal being located at selected inner and/or outer portion(s) which are at right angles to the article internal seals forming essentially flat and unruffled constant length seals which remain as such whether said articles are inflated or deflated and which permits the centerlines of the inflatable units of said articles to shorten or lengthen upon inflation or deflation respectively without causing said selected inner and/or outer portions to ruffle.

Another feature of the present invention is to make it possible to join the subject inflatable article to various materials including plastics by various means such as heat, direct and induced, thread, glueing, snaps, buttons, eyelettes, rivets, metal and plastic clamps, hole and collar button combinations, etc.. Said materials may include textiles, wood, metal, paper, glass, other plastics that are not thermoplastics, etc..

Another feature of the present invention is to permit the joining of the inflatable article to other components to form other articles, which may be of the same or different kinds of materials, on a flat plane, in-line plane or a parallel plane, at right angles and other angles without distortion being caused by inflating of the inflatable article.

Those and other features, objects and advantages of the present invention will become apparent from the following detailed description of the preferred embodiments of the present invention with reference to the accompanying drawings, wherein:

DETAILED DESCRIPTION OF THE PREFERRED EMBODIMENT

Figure 1:
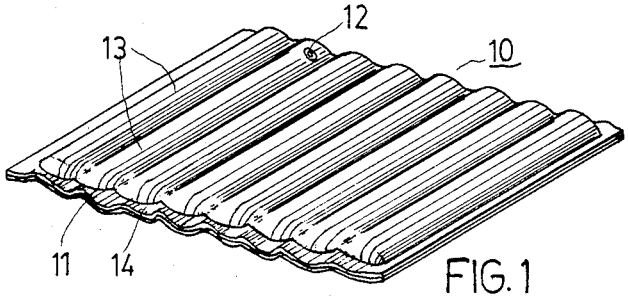
FIG. 1 is a perspective view of first embodiment of the basic inflatable according to the present invention.

Referring to FIGS. 1 to 4 which show four types of basic inflatables according to the present invention, a basic inflatable 10 of the first type shown in FIG. 1 is made of two sheets of air impervious thermoplastic sheet materials heat sealed together with a plurality of vertical bar seals 11 within the outer portions and an inflating valve 12 provided on one of said two sheet materials for injecting air into the basic inflatable 10. Since the bar seals 11 do not touch the seals at the outer portions 14, air contained therein can pass between the inflatable spaces 13 formed by the bar seals 11.

Figure 2:
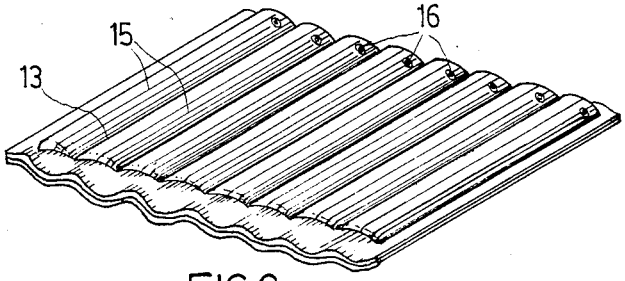
FIG. 2 is a perspective view of second embodiment of the basic inflatable according to the present invention.

A second type of the basic inflatable is shown in FIG. 2 wherein the bar seals 14 extend to and touch the seals at the outer portions forming a number of individual inflatable unites 15 each having a valve 16.

Figure 3A:
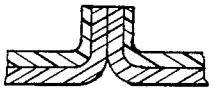
FIG. 3 is a perspective view of third embodiment of the basic inflatable according to the present invention.
Figure 3B:
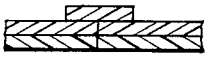
Figure 3:
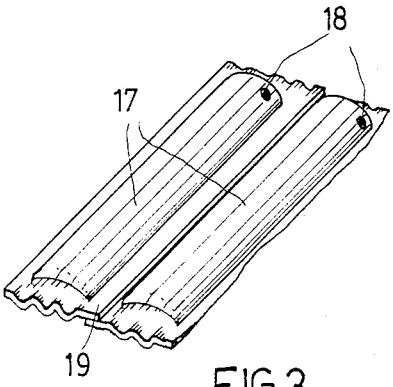

FIG. 3 shows a third type of the basic inflatable which comprises a plurality of individual inflatable units 17 each having an inflating valve 18 provided thereon. Said units 17 are joined by their overlapped outer portion 19 to form a basic inflatable. The outer portions 19 of two adjacent inflatable units may be joined with an edge parallel joining as shown in FIG. 3*a* or a butt parallel joining as shown in FIG. 3*b*.

Figure 4:
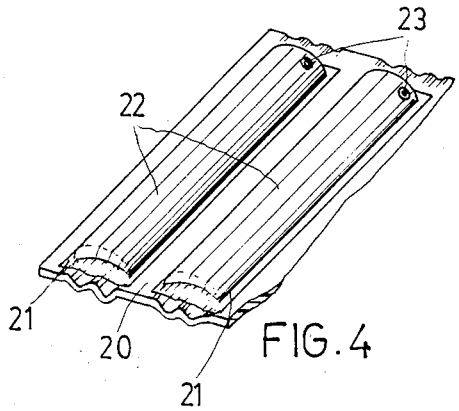
FIG. 4 is a perspective view of fourth embodiment of the basic inflatable according to the present invention.

A fourth type of the basic inflatable is shown in FIG. 4 which comprises a single sheet of thermoplastic material 20 to which is attached individual sheets of thermoplastic materials forming individual inflatable units 22 each having its own inflating valve 23 thereon.

The purpose of these types of basic inflatables is to provide the opportunity to use materials of different colors, thicknesses, firmness etc. as may be required by the inflatable article.

Figure 5:
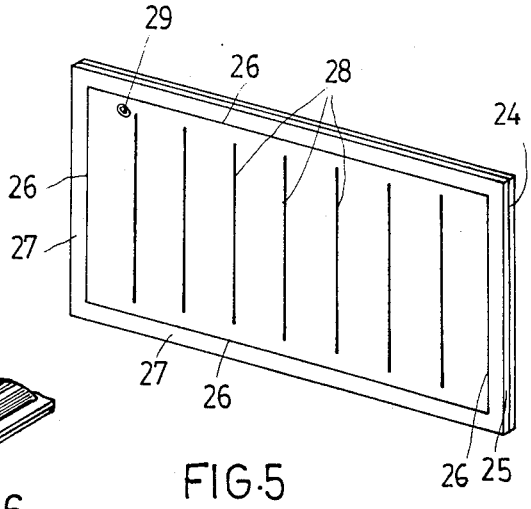
FIG. 5 is a perspective view of a basic inflatable having two sheets of air impervious thermoplastics heat sealed at and within the outer portions.

Referring to FIG. 5 which shows a perspective view of a basic inflatable, two sheets of thermoplastic material 24, 25 are placed with one on top of the other and have seals 26 at the outer portions 27 and a plurality of parallel flat bar seals 28 within the outer portions 27. The basic inflatable has an inflating valve 29 located on the top sheet 25 for injecting air into the space between said two sheets 24 and 25. The lateral centerline is CL 1.

Figure 6:
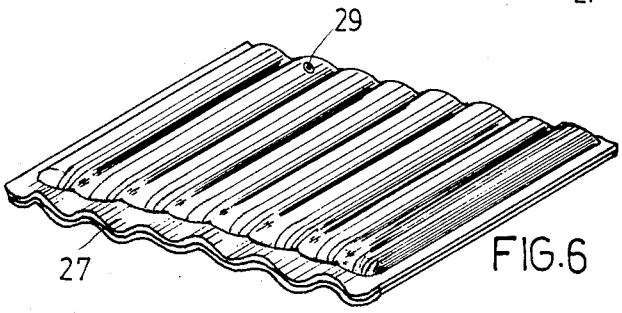
FIG. 6 is a perspective view of the basic inflatable in FIG. 5 after inflation.

FIG. 6 shows the basic inflatable after inflation. It is seen that the outer portions 27 perpendicular to the bar seals 28 become ruffled after inflation due to shortening of centerline CL 1.

Figure 7:
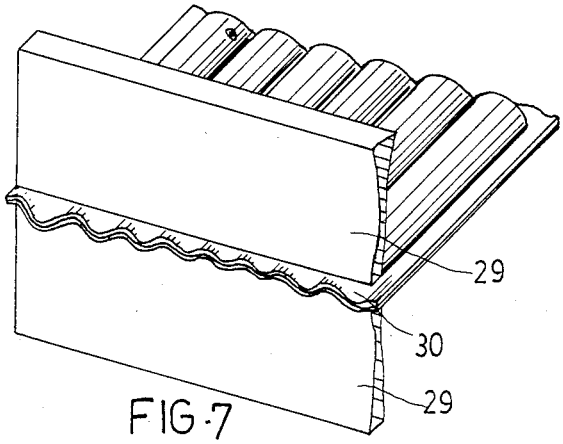
FIG. 7 is a perspective view showing the ruffles of the basic inflatable in FIG. 7 being flattened and thus stabilized by a heat sealing die.

Referring to FIG. 7, the basic inflatable is placed in a press on a heat sealing die 29 which provides the pressure and the means for providing the heat on a selected outer portion 30 of the basic inflatable and flattens said portion 30 to become a flat and unruffled, i.e. stabilized outer portion. It is understood that there are two or more heat seals on the outer portion 30 with one adjacent to or touching with the other. At least one or more of said seals form the basic inflatable and provides the stabilizing seal.

Figure 8:
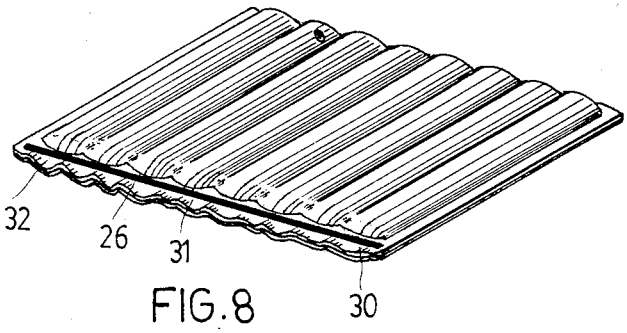
FIG. 8 is a side view of the basic inflatable in FIG. 7 after the ruffles thereof have been stabilized.

The resultant inflatable article is shown in FIG. 8 wherein the outer portion 30 shows a ruffled edge 31 and a flat stabilized seal 32 between said edge 31 and the seal 26 of the basic inflatable. This ruffled outer edge 31 may be eliminated by using a die that is wide enough to cover the edge 31 of the outer portion 30 or by using a die having a cutting edge which cuts away the ruffled edge 31 during stabilizing. The stabilized seal 32 on outer portion 30 remains a constant length and is unchanged whether there is inflation or deflation of the inflatable article.

Figure 9:
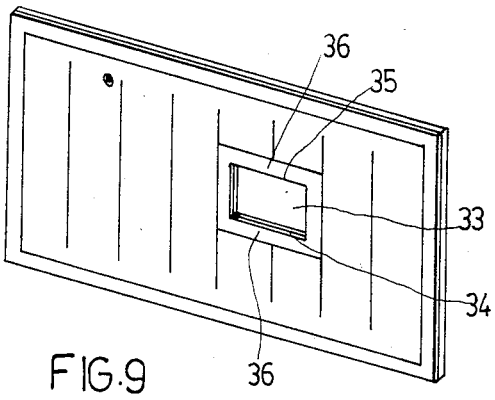
FIG. 9 is a perspective view of another embodiment of the basic inflatable having opening and ruffles at the selected inner portion to be stabilized.

Referring to FIG. 9 which shows a basic inflatable having an inner opening 33 with edges 34, 35 which will ruffle upon inflation at the inner portions 36 of said opening 33, the ruffled portions 36 can be stabilized with an inner stabilized seal by the same process of the outer stabilized seal stated in FIGS. 5 to 8. The basic inflatable can be stabilized and become an inflatable article of the present invention. It is to be noted that the basic inflatable shown in FIG. 9 having an inner opening can also be applied to the various types of the basic inflatables shown in FIGS. 1 to 4. It is a simple operation to provide an inner opening to the basic inflatables shown in FIGS. 2 to 4.

The process stated hereinabove with reference to FIGS. 5 to 8 is tha basic process to make an inflatable article of the present invention having stabilized portions. The resultant inflatable article can be further attached to another article or components of another article to form another article. In FIG. 7 the basic inflatable is stabilized with the same in an inflated condition. However in the actual performance of the stabilizing process, the basic inflatable may be deflated after being clamped into the heat sealing dies so that less stress will be at the portions to be stabilized.

The inflatable article of the present invention can be attached or joined to other articles or components of other articles at the selected outer and/or inner portions, which have been stabilized by flat parallel attachment, tubular die attachment, in-line attachment, or other kinds of attachment.

Figure 10:
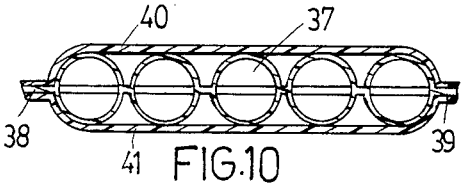
FIG. 10 is a perspective view of the parallel joining of the inflatable article of the present invention.

FIG. 10 shows an example of a flat parallel joining. An inflatable article 37 is stabilized at the selected outer portions 38, 39 first in an inflated condition. Another component 40 or 41 which may be a printed sign is joined to said article 37 whether article 37 is in an inflated or deflated condition. It is easily understood that the component 40 or 41 will have the desired dimension after the section 37 is inflated.

Figure 11A:
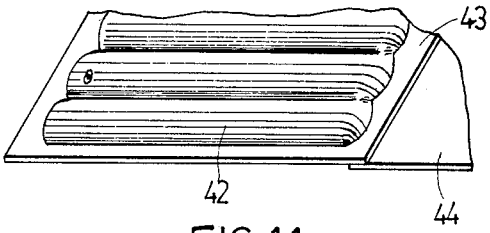
FIGS. 11*a*, 11*b* and 11*c* are perspective views of a series of in-line joinings of the inflatable article of the present invention.
Figure 11B:
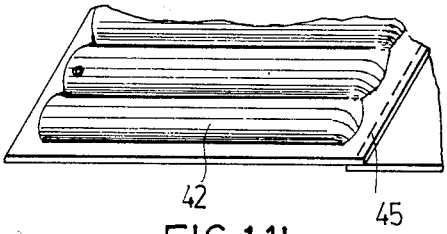
Figure 11C:
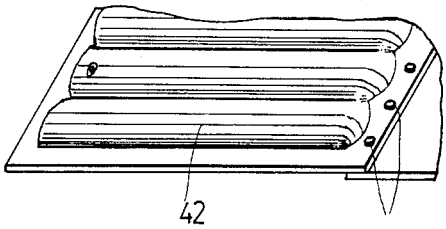

FIGS. 11*a* to 11*c* show an examples of in-line joinings. The inflatable article 42 having stabilized outer portion 43 is joined to another component 44 by direct heat. It is to be nthat he component 44 can also be an inflatable article. The joining between article 42 and 44 can be made by indirect high frequency heat sealing or by applying glue. Said joining between article and component of another article can be made by adopting means for joining such as thread, clips or fasteners such as snaps and buttons, glueing, eyelettes, rivets, metal and plastic clamps, hole and collar button combinations etc.. Different ways of joining are shown in FIGS. 11*b* to 11*c* wherein thread 45, and snaps 46 are used as the means for joining. It is apparent that the joining shown in the example of FIG. 11*c* is a detachable joining.

Figure 12:
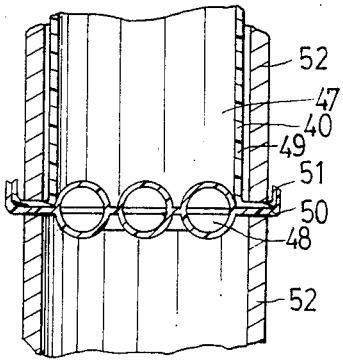
FIG. 12 is a sectional view of the tubular joining of the present invention.

FIG. 12 shows an example of a tubular attachment of the inflatable article as a sectional view. A round bag 47 consists of a round inflatable bottom 48 and a plastic wall 49 and can be made by stabilizing the outer round portion 50 of the bottom 48 and heat sealing the bottom portion 51 of the wall 49 at the same time as they are heat sealed by a tubular die 52. If the outer round portion 50 of the bottom 48 was not stabilized, it could not be attached to the tubular plastic wall since its periphery would shorten on inflation due to the widths of the inflatable units shortening and lengthening on inflation and deflation and cause a distorted shape instead of one with the same periphery as the tubular part 49 attached.

Figure 13:
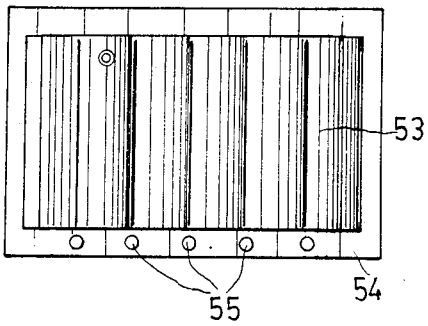
FIG. 13 shows a perspective view of the inflatable article of the present invention having holes provided thereon for joining to another article or component.

FIG. 13 is another example of the inflatable article of the present invention. The inflatable article 53 has a stabilized seal 54 whereon a plurality of holes 55 are provided for further joining with another article or a component of another article.

Figure 14:
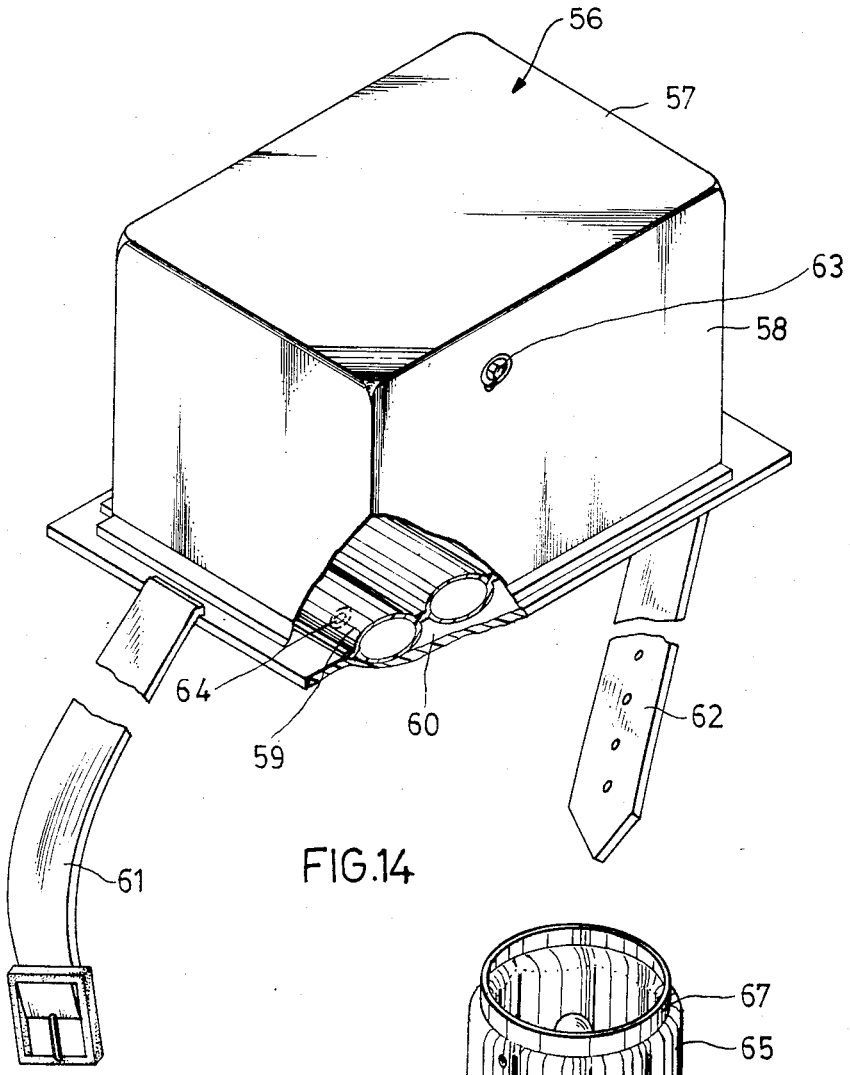
FIG. 14 is a perspective view of a swimming aid formed by using the method and article of the present invention.

The examples shown in FIGS. 10 to 13 are various embodiments of the present invention. One skilled in the art may make changes or modifications based on the above-described embodiments. FIG. 14 shows a perspective view of an inflatable swimming aid made by the method of the present invention. The swimming aid 56 consists of a top section 57 which is a flat sheet, a square tubular sheet 58 and a bottom section 59 which consists of two rectangular sheets made into an inflatable stabilized section and then joined to section 58 and flat sheet section 60. The said sheet section 60 has a pair of fastening straps 61 and 62 provided thereon. In this effective example of a swimming aid, applications of flat parallel joining and tubular joining are demonstrated. Air inflating valves 63 and 64 are located on sections 58 and 59 respectively.

Figure 15:
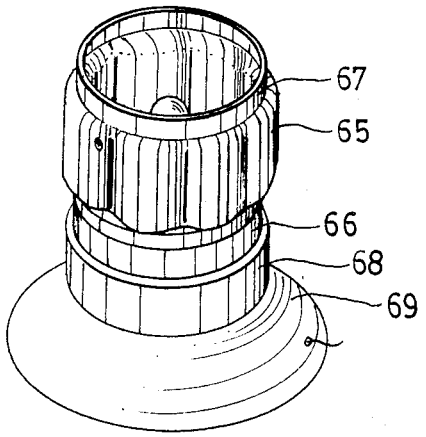
FIG. 15 is a perspective view of a lamp with a lamp shade embodiment made by using the method and article of the present invention.

FIG. 15 is a perspective view of a lamp with a lamp shade formed by the inflatable article of the present invention. The lamp shade 65 is formed by an inflatable article of the present invention, as that shown in FIG. 8, made into a cylinder wherein the bottom edge is inserted into a clamp 66 fitting within the clamp 68 of the lamp base 69, and the top edge 67 is a stabilized portion too. The inflatable lamp shade 65 can be made from a basic inflatable of the type shown in FIGS. 3 or 4 by which different colored inflatable units can be achieved.

Figure 16:
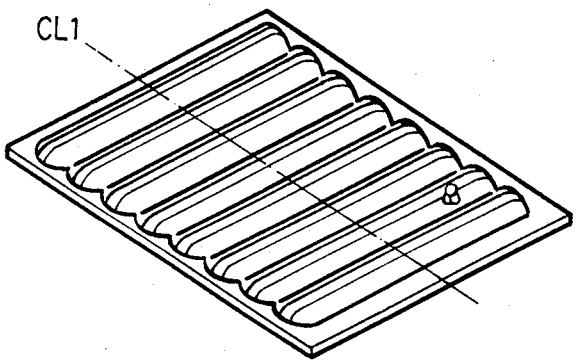
FIG. 16 shows an inflated state of an inflatable article which has been stabilized along the direction parallel to the centerline according to the present invention.
Figure 17:
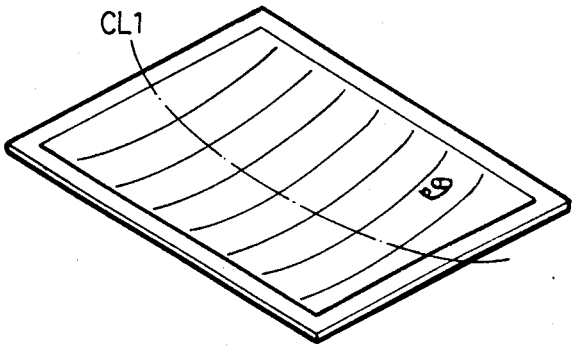
FIG. 17 show an deflated state of an inflated article as shown in FIG. 16.

As shown in FIGS. 16 and 17, it can be clearly noted that an inflatable article with stabilizing seal, when deflated, will not change its size in length and width. Only the distance between two parallel outside seal bars will lengthen causing the material inbetween to sag.

Although the present invention has been described hereinbefore by way of preferred embodiments, it should be understood that various changes or modifications are still possible by those skilled in the art without departing from the spirit and scope of the present invention.

I claim:

1. An inflatable article made of air impervious thermoplastic sheet materials, comprising: at least one inflatable unit having an inflating valve provided thereon and having normally ruffled portions located outside of air enclosing seals wherein there is located on at least one selected portion a stabilizing seal adjacent to an air enclosing seal to provide an essentially flat and unruffled constant length seal which remains as such whether said article is inflated or deflated and which permits a center line through said inflatable unit to shorten and lengthen upon inflation and deflation, respectively, without causing said selected portion to ruffle upon inflation and which does not permit said article to lay flat upon deflation.

2. An inflatable article according to claim 1 wherein said inflatable unit is comprised of two sheets of thermoplastic materials located with one on top of the other having coinciding inner and outer portions, with seals at and within said outer portions with an inflating valve located on either one of said two sheets, with air being confined within the outer portion and being able to pass between the spaces formed by the seals within the outer portions.

3. An inflatable article according to claim 1 wherein said inflatable unit comprises two sheets of thermoplastic materials located with one on top of the other having coinciding inner and outer portions, with seals at and within said outer portions with an inflating valve located on either one or said two sheets, said seals within said outer portions provide completely enclosed units and there being provided on said sheets of thermoplastic materials individual valves for injecting air into said enclosed units.

4. An inflatable article according to claim 1 wherein said inflatable article is comprised of more than one inflatable unit joined together, each one of said units being comprised of two sheets of thermoplastic materials located with one on top of the other having coinciding inner and outer portions with an inflating valve located on one of said two sheets and there being seals at said outer portions to retain air within said inflatable unit.

5. An inflatable article according to claim 1 wherein said inflatable article is comprised of more than one inflatable unit and consisting of a sheet of thermoplastic material having located thereon individual sheets of thermoplastic material having seals around each of said individual sheets and having provided inflating valves for each unit formed by each of said individual sheets.

6. An inflatable article according to claim 1, wherein said stabilizing seal or the stabilized portion provided by said stabilizing seal has joining with one or more of other components to form other articles.

7. An inflatable article according to claim 1, further comprising means for joining said inflatable article to other articles.

8. An inflatable article according to claim 1 said inflatable unit and said seals are formed by two unitary thermoplastic sheets, said stabilizing seal directly coupling said sheets by the application of heat and pressure.

9. An inflatable article, rounded in shape made of air impervious thermoplastic sheet materials, comprising: at least one rounded inflatable unit formed by an outer seal and at least one inner concentric seal and having an inflating valve provided thereon, wherein there is located at an outer portion a stabilizing seal adjacent to said outer seal to provide an essentially flat and unruffled constant length seal which remains as such whether said article is inflated or deflated and does not permit the article to lay flat upon deflation and which permits the widths of said inflatable unit to shorten and lengthen upon inflation and deflation without causing said outer portion around said article to ruffle on inflation.

10. An inflatable article according to claim 9 further comprising means for joining said inflatable article to other articles.

* * * * *